US005145523A

United States Patent [19]

Halpin et al.

[11] Patent Number: 5,145,523

[45] Date of Patent: Sep. 8, 1992

[54] SOLUTIONS FOR CLEANING PLASTIC AND METALLIC SURFACES

[75] Inventors: John M. Halpin, Bellevue; David J. Quam, Seattle, both of Wash.

[73] Assignee: Van Waters and Rogers, Inc., Seattle, Wash.

[21] Appl. No.: 641,619

[22] Filed: Jan. 22, 1991

[51] Int. Cl.[5] ..... C11D 7/26

[52] U.S. Cl. ..... 106/287.24; 106/285; 106/311; 252/170

[58] Field of Search ..... 106/285, 287.24, 311; 252/170

[56] References Cited

U.S. PATENT DOCUMENTS

| | | | |
|---|---|---|---|
| 3,663,255 | 5/1972 | Vivian | 106/285 |
| 4,028,117 | 6/1977 | Moat | 106/285 |
| 4,183,819 | 1/1980 | Stolove | 252/144 |
| 4,544,413 | 10/1985 | Boots et al. | 106/287.14 |
| 4,919,839 | 4/1990 | Durbut et al. | 252/153 |
| 4,992,187 | 2/1991 | Adams et al. | 252/50 |

*Primary Examiner*—Theodore Morris
*Assistant Examiner*—David M. Brunsman
*Attorney, Agent, or Firm*—Christensen, O'Connor, Johnson & Kindness

[57] ABSTRACT

Liquid solutions for cleaning plastic and metallic surfaces and methods of cleaning such surfaces using the solutions are disclosed. The solutions may be used to clean audio/video tapes and tape-engaging parts, computer diskettes, electrical components, video screens, etc. The solutions comprise an isoparaffinic hydrocarbon solvent, a glycol ether, and, optionally, a monohydric branched alcohol having 4 to 10 carbon atoms.

20 Claims, 1 Drawing Sheet

SOLUTIONS FOR CLEANING PLASTIC AND METALLIC SURFACES

FIELD OF THE INVENTION

This invention relates to solutions including solvents, for cleaning plastic and metallic surfaces, such as magnetic tapes, the tape-contacting surfaces of audio and video recorders, the plastic surfaces of compact discs, circuit boards, and other electronic components, etc.

BACKGROUND OF THE INVENTION

Audio/video tape-contacting heads, magnetic tapes, and other metallic and plastic surfaces have been cleaned in the past with various types of solutions that remove dust and other foreign particles and substances. Conventional cleaner solutions have also been used to extend the life of the recorder by improving the tonal and/or visual qualities of the information contained in magnetic and other tapes. These prior solutions have not been entirely satisfactory due to one or more of the following problems: low cleaning power, incompatibility with the surfaces to be cleaned, bad odor, toxicity, and high degree of flammability.

For years, isopropyl alcohol was the standard audio/video tape cleaner, offering excellent cleaning, good evaporation, and a mild odor. Its principal disadvantages were its low flash point, making it flammable, and its internal and ocular toxicity. In specific types of cleaning, certain types of residues are not as effectively cleaned with isopropyl alcohol as with other solutions.

An improved product compared to isopropyl alcohol that gained wide success was "Blend 56" which, at one time, led the market in audio/video cleaner solutions. Blend 56 consists of 85% isopropyl alcohol and 15% Freon®-TF. The introduction of Freon®-TF into isopropyl alcohol resulted in a mixture having enhanced cleaning capability because of the synergistic relationship between the two ingredients. The resulting blend efficiently and effectively removes organic residue such as light oil, fingerprints, dust, grime, oxides, and other substances. Freon®-TF has a high flash point, fast evaporation, low toxicity, and excellent solvency. Its principal disadvantages are environmental concerns involving ozone depletion, and its high expense.

Because of the drawbacks associated with Blend 56, especially the environmental concerns mentioned above, alternatives to Blend 56 are now needed. It is notable that E. I. DuPont de Nemours and Company, Inc., the manufacturer of Freon®, has announced the termination of Freon® production in accordance with International Convention. Freon® will still be available through 1999, but its price will be rapidly increasing due to increased cost of production and added Federal taxes, and its availability will be decreasing with each passing year. Freon® is presently banned entirely in Europe.

Other solutions designed to clean and preserve surfaces are disclosed in the following prior U.S. patents:

U.S. Pat. No. 4,544,413 discloses a chemical solution for use in cleaning and preserving vinyl material, such as phonograph records, and metallic surfaces, such as the tape-engaging surfaces of read-write heads of audio and video tape recorders. The solution includes one or more solvents as carriers for a silicon (e.g., dimethysiloxane polymer), an organo functional silane, and other intermediates such as one or more alcohols, ethers, ketones and halogenated hydrocarbons.

U.S. Pat. No. 4,183,819 discloses solutions and methods for cleaning, polishing and lubricating magnetic heads. These solutions include a mixture of micropulverized inorganic oxides, a mixture of lower alkyl silanes, an alkaline earth metal carbonate, a long chain fatty acid having from 16 to 20 carbon atoms, and a solvent mixture of lower alkyl alcohols having from about 1 to 4 carbon atoms.

In spite of the above exemplary prior solutions for cleaning plastic and metallic surfaces, there continues to exist a need for new and improved solutions of this type. Such solutions are difficult to develop because of a number of requirements imposed on such solutions. For example, an acceptable cleaning solution must: have an acceptable flash point (above 100° F.), have an appropriate evaporation rate, have low odor, not be too corrosive for plastics or other surfaces, be nonaqueous, have low toxicity, not leave undesirable residues, and be environmentally acceptable.

The present inventors have investigated a variety of different mixtures of chemicals in an attempt to discover new types of solutions that could be utilized to clean metallic and plastic surfaces, keeping the above factors in mind. The present invention resulted from such investigations.

SUMMARY OF THE INVENTION

The present invention is directed to liquid solutions that are useful in cleaning metallic and plastic surfaces, and to methods of cleaning such surfaces utilizing these solutions. In broad terms, the solutions of the present invention include at least one isoparaffinic hydrocarbon solvent having a boiling point of about 300°–400° F. and a flash point above about 100° F., and a glycol ether. In some embodiments of the present invention, the liquid solutions further include a branched chain monohydric alcohol.

The solutions of the present invention may be used for the purposes of cleaning plastic or metallic surfaces of all types. They are preferably utilized to clean plastic or metallic surfaces associated with electronic devices and components, metallic or plastic audio or video tapes, the surfaces of compact discs or records, computer discs, the tape-engaging heads of audio or video recorders, and the like.

The methods of the present invention involve applying one or more solutions of the present invention to a surface to be cleaned and then wiping the solution from the surface to remove or redistribute foreign materials on the surface being cleaned.

DETAILED DESCRIPTION OF THE PREFERRED EMBODIMENTS

Figure 1:
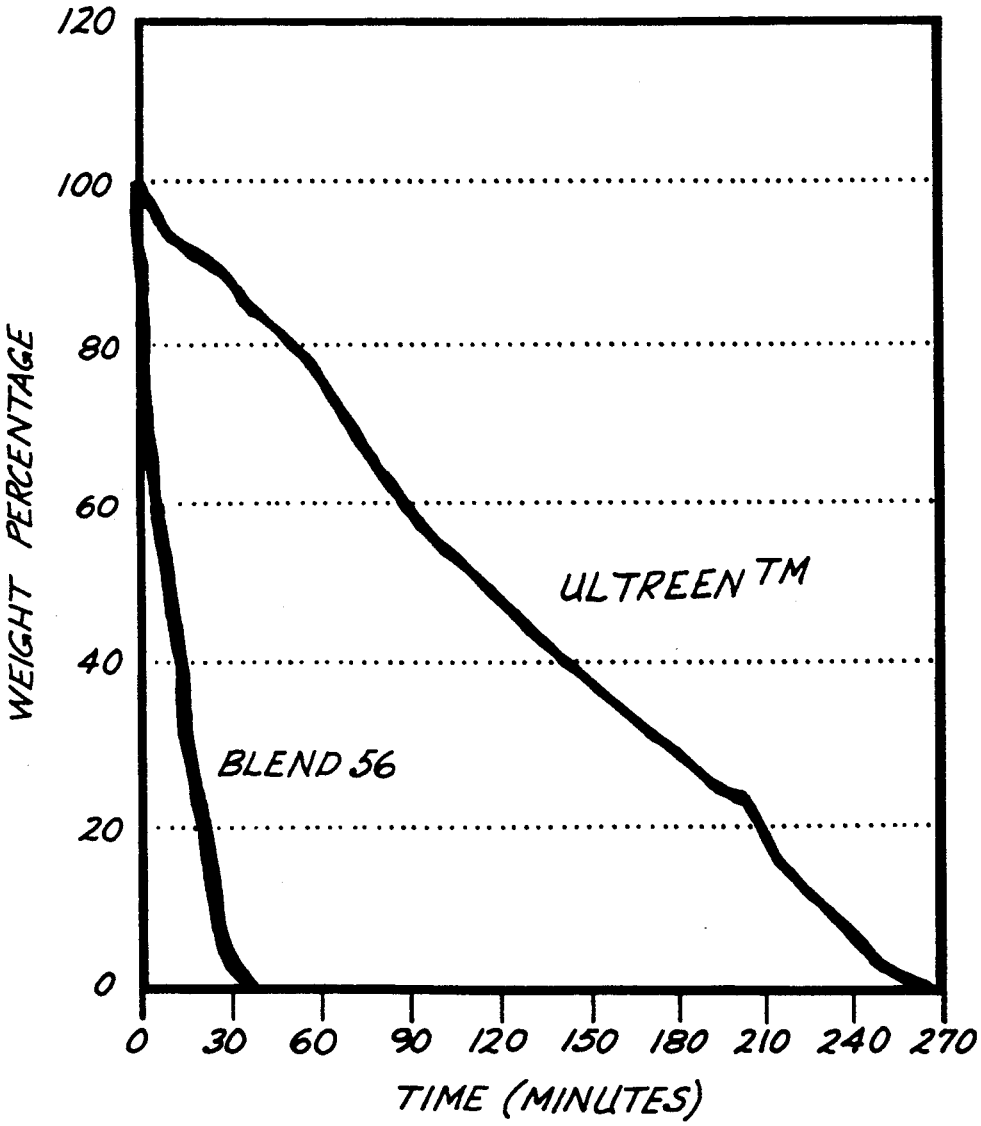
FIG. 1 shows in graph form the results of a comparative evaporation test between Ultreen TM, a cleaning solution of the present invention, and Blend 56.

Generally, as summarized above, the present liquid solutions comprise at least one isoparaffinic hydrocarbon solvent having a boiling point of from about 300°–405° F. and a flash point above about 100° F., a glycol ether and, optionally, a branched chain monohydric alcohol. A preferred boiling point range is 315°–375° F.

The isoparaffinic hydrocarbon solvent of the present invention is preferably a mixture of $C_8$–$C_{12}$ branched aliphatic hydrocarbons. These isoparaffinic hydrocarbon solvents may be obtained by distilling isoparaffinic hydrocarbons and obtaining narrow "cuts" over defined boiling point ranges. Such isoparaffinic hydrocarbon solvents are substantially odorless, possessing only a very mild paraffinic odor.

Particularly preferably, the isoparaffinic hydrocarbon solvent is a mixture of hydrocarbon solvents sold under the trade name Isopar® G and Isopar® H and manufactured by the Exxon Corporation, or equivalents thereof. Isopar® G is a narrow-cut isoparaffinic solvent with a boiling point range of 315°–348° and with a flash point above 100° F. Isopar® H is an isoparaffinic hydrocarbon solvent with a boiling point range of 348°–375° F. and a flash point of about 127° F. Other possibly useful isoparaffinic solvents are those sold under the trade name Isopar® K and Isopar® L. Isopar® K is an isoparaffinic composition with a boiling point range of 350°–386° F. Isopar® L is a heavy narrow-cut with a high initial boiling point (about 365°–403° F.). Isopar® G and H are preferred as compared to Isopar® K and L. It is also possible to include a combination of isoparaffinic mixtures (e.g., a combination of Isopar® G and Isopar® K) in the present solutions.

The glycol ether of the present invention contributes to the cleaning power of the solutions of this invention. A suitable group of glycol ethers is represented by the following formula:

$$R-O-((\underset{\underset{R''}{|}}{C}-H)_X-O)_Y-R'$$

wherein X is 2 or 3; Y is 1, 2, or 3; and R, R', and R'' are independently selected from H and $C_{1-6}$ alkyl, with the proviso that at least one of R and R' is not hydrogen. As used herein, "alkyl" means a group that is straight chain, branched, cyclic, or a mixture thereof. Preferably, Y is 1 or 2 and R, R' and R'' are independently selected from $C_{2-4}$ alkyl. Exemplary preferred glycol ethers for the purposes of this invention are the following: ethylene glycol n-butyl ether, diethylene glycol n-butyl ether, propylene glycol n-butyl ether, and dipropylene glycol n-butyl ether. The most preferred glycol ether for purposes of this invention is a propylene glycol n-butyl ether, such as the one sold under the trade name Dowanol® PnB by Dow Chemical Co. Mixtures of one or more of these glycol ethers may also be employed in the present solutions.

The combination of the isoparaffinic hydrocarbon solvent(s) and glycol ether(s) will preferably have a flash point of greater than 100° F.; a flash point range of 102°–145° F. is especially useful.

In addition to the above-described ingredients, in another embodiment of the present invention, the present solutions further include a monohydric alkyl alcohol. Preferably, the alcohol will have from 4 to 10 carbon atoms in total, and will have a flash point of at least about 100° F. Two exemplary alcohols that are suitable for the present invention are 2-methyl-1-pentanol and 2-ethyl-1-butyl alcohol, the latter being preferred. From the viewpoint of minimizing hydrocarbon odor, shorter (e.g., $C_{4-6}$) rather than larger (e.g., $C_{7-10}$) chains are preferred.

The alcohols of the present invention are included to enhance the polarity of the cleaning solution, when necessary. Thus, the solutions containing the alcohol will be able to dissolve and/or disperse relatively polar types of contaminants. The alcohols are also useful to lift off iron oxide residue deposited on the surface of tape-engaging heads or magnetic tapes, and to dissolve this residue in the cleaning solution. During evaporation or after evaporation of the constituents of the solution from the surface to be cleaned, preferably a clean material or cloth is used to wipe off the dispersed or dissolved foreign materials.

The solutions of the present invention will contain the above-described ingredients in amounts that are effective to clean the surface of interest. The solutions of the present invention that do not contain an alcohol preferably contain about 92% to about 98% by volume of the isoparaffinic solvent. The glycol ether will preferably be contained in an amount of from about 2% to 8% by volume in the solution. When an alcohol is included in the solutions, it will preferably replace a portion of the isoparaffinic hydrocarbon solvent, up to an amount of about 35% by volume of the solution. At least about 2% by volume of the glycol ether should remain after inclusion of the alcohol in the solution.

A particularly preferred solution for purposes of the present invention contains the following ingredients in the indicated amounts:

Isopar® G-83% by volume

Isopar® H-14% by volume

Propylene glycol n-butyl ether (e.g., Dowanol® PnB)—3% by volume The above composition and related compositions are referred to as "Ultreen™". Other exemplary compositions are described in the Examples section below.

The liquid solutions described above are prepared by adding the components together in any order and allowing them to mix until a homogeneous liquid is obtained.

The solutions of the present invention may be used to clean a variety of plastic and metallic surfaces. To determine whether a solution of the present invention is useful in cleaning a particular surface, one of ordinary skill in the art can carry out standard tests to ensure that the solution is compatible with the surface to be cleaned and is effective to carry out the cleaning. For example, tests analogous to those described below in the Examples section can be used.

Some examples of the types of articles whose surfaces can be cleaned by the present solutions are the following: circuit boards, video screens, platens on printers, tape-engaging heads or parts of audio or video recorders, compact disc player heads and capstans, compact disc surfaces, computer discs, and the like. The solutions of the present invention can be applied first to a small applicator, such as a pad or piece of cloth or cotton, and then wiped directly on the surface to be cleaned, followed preferably by removal with a clean material. Alternatively, the solutions can be sprayed directly onto the surface and wiped off. The solutions may be also applied by an applicator device to a surface to be cleaned and allowed to dry or wiped off with the same or separate device.

The amount of cleaner to be applied will depend on the amount of contamination to be removed, the surface area of the surface, the mode of application, the specific formulation, etc. For most small-scale cleaning operations, a few cc's (e.g., 2–10) will suffice. One of ordinary skill in the art will be able to optimize the effective amount in a given situation by standard and/or routine experimentation.

As used herein, the phrase "consisting essentially of" means that the solution does not exclude unspecified materials which do not prevent the advantages of the cleaning solution from being realized. An exemplary additional component is an odor-masking additive (e.g., d-limonene).

The following examples are provided to illustrate the advantages of the present invention and to assist one of ordinary skill in the art in making and using the same. The examples are not intended in any way to limit the scope of the disclosure and the protection granted by Letters Patent hereon.

EXAMPLES

The following examples illustrate the effectiveness of Ultreen TM as a tape and disc-cleaning solvent as compared to Blend 56.

The formula of Ultreen TM and Blend 56 are provided above. Ultreen TM was examined for its integrity with five different tests: the Evaporation Rate Test, the Detrimental Effects Test, the Life Test, Residue Test, and Cleaning Effectiveness Test.

A. EVAPORATION RATE TEST

Purpose of Test

To determine the evaporation rate of Ultreen TM at room temperature as compared to Blend 56. Volume used was 1 cc.

Materials and Method

The evaporation rate of both Ultreen TM and Blend 56 were determined using the same process. A clean glass Petri dish was weighed using a Mettler PE 3600 scale, which is accurate to 0.01 gram. One cc of the cleaner was placed in the dish, and the change in weight with time was recorded periodically. The results are shown in FIG. 1. A good estimate of the evaporation rate is the slope of the evaporation rate line.

Results

It was found that Blend 56 evaporates quickly. It took approximately 36 minutes and 20 seconds for 1 cc to evaporate, a rate of $1.41\times10^{-3}$ cc/min/cm$^2$. Ultreen TM took a longer period of time, 4 hours, 27 minutes, and 55 seconds for 1 cc to evaporate. This is a rate of $1.90\times10^{-4}$ cc/min/cm$^2$. Thus, Ultreen TM evaporates 7.44 times slower than Blend 56.

B. DETRIMENTAL EFFECTS TEST

Purpose of Test

To examine several items which come in contact with the cleaning solution and then reexamine them after soaking in Ultreen TM for 200 continuous hours.

Materials and Methods

The test items were first weighed on the Mettler PE 3600 scale; then they were placed in glass beakers and covered with Ultreen TM. Two hundred hours later, the items were taken out of the Ultreen TM and laid on paper towels to dry. Sixty-four hours later, the items were weighed again to help determine if the items were degraded by the Ultreen TM or were absorbing it and then examined under a stereo microscope at a magnification range from 14 X to 80 X.

Results

Table 1 (below) shows the before and after weights of the items and the observations made using the microscope. There are a few items that changed several hundredths of a gram; these were generally items that could hold moisture for a long period of time such as the solution bottles or had their labels come off due to the loss of adhesive. In general, the Ultreen TM did not degrade the items with the exception of a very slight fading on the stamped model number on the audio head.

TABLE 1

| Item | Weight in Grams Before | After | Observations |
|---|---|---|---|
| Video Head | 75.58 | 75.58 | NVC* |
| Audio Head | 4.31 | 4.31 | INK FADED |
| Compact Disc | 16.95 | 16.95 | NVC |
| Pinch Roller | 4.39 | 4.39 | NVC |
| Nylon Guide Pins | 1.41 | 1.41 | NVC |
| Audio Tape | 0.02 | 0.02 | NVC |
| Audio Cleaner Case | 29.99 | 30.01 | Moisture Inside |
| Video Cleaner Case | 110.66 | 110.68 | NVC |
| Cleaning Ribbon | 0.19 | 0.2 | NVC |
| Cleaning Pads | 0.13 | 0.13 | NVC |
| Cleaning Foam | 0.07 | 0.08 | NVC |
| Solution Bottle (Red) | 7.11 | 7.27 | NVC |
| Solution Bottle (Black) | 3.9 | 3.97 | NVC |
| Solution Bottle Cap | 1.04 | 1.05 | NVC |
| Solution Bottle Tip | 0.57 | 0.59 | NVC |
| Floppy Disc Cleaner (5.25) | 13.19 | 13.12 | Label Came Off |
| Floppy Disc Cleaner (3.5) | 17.52 | 17.48 | Label Came Off |
| Cleaning Cartridge | 39.03 | 38.97 | Label Came Off |
| Drive Belt | 0.69 | 0.67 | Slightly Stiff |

*No Visible Change

C. LIFE TEST

Description of Test

Record a tape using a signal generator and check playback on an oscilloscope. Clean the VCR with a Model 61000 Cleaner for a total of 25 cleaning cycles. Replay the recorded test tape checking playback on an oscilloscope. Repeat this operation 6 times noting any changes in the oscilloscope readings. Repeat the test using Blend 56.

Materials and Method

Equipment Used:

1. B & K Digital I.C. Color Generator Model 1246
2. Hitachi Oscilloscope Model V-1065
3. Mitsubishi VCR Model HS 413 ur Oscilloscope Settings:

sweep: 0.2 US/DIV
vertical: 0.5 V/DIV
trigger: AUTO
slope: NONE
coupling: AC

Signal Composition:

The signal recorded on the tape was derived from a B & K I.C. color generator set for a gaited rainbow output at a level that would give a 2.2 V PP video signal contained within the composite video signal.

Test Procedure:

1. Recorded an RF signal from the color generator at CH 3 output to the VCR VHF 75 OHM input for 1 minute.

2. The next 1 to 2 minute section on the test tape was left blank by setting the VCR to record with no signal input.

3. The 2 to 3 minute section was used to record a signal of the same amplitude and composition as on the first 0 to 1 minute section.

4. The testing procedure consisted of running a cleaning cartridge treated with Ultreen TM at each cleaning 25 times through the test VCR. The test tape was then run through the test VCR. The signal level was observed with the scope for any drop in amplitude and was recorded. The above cycle was run six times.

Another cleaning cartridge treated with Blend 56 was then run through the same procedure as above and the signal level was observed and recorded.

If, after the first set of tests was completed, a signal reduction of greater than 10% was observed, then the test was stopped and the setup investigated for cause of the signal reduction.

Results

There was no signal reduction, though there were occasional drop outs, probably caused by interference or the tripping device on the oscilloscope.

After the second cleaning cycles with the Blend 56, there was a drop in the signal of one volt. This change in voltage indicates possible damage of the tape or of the head on the VCR. It is uncertain what caused the signal reduction. Since the same VCR and tape was used with both cleaning solutions, it is unclear if the tape or VCR was damaged by just the Blend 56, a combination of first the Ultreen TM and the Blend 56, a poor quality of defective tape, the cleaning process or cleaning equipment, or a combination of the above. Later retesting seems to indicate damage to the tape from another source.

D. RESIDUE TEST

Description of Test

Weigh a clean dry petri dish. Add 5 cc of Ultreen TM and let it stand at room temperature until it is dry. Reweigh the dish and note any change in weight or residue left on the dish. Repeat five times. Complete the same test using Blend 56.

Materials and Method

The amounts of residue for both Ultreen TM and Blend 56 were determined the same way. Ten clean dry petri dishes were weighed with a Mettler AE 100 scale which can record the weight to 0.0001 grams. However, reading out to the 0.0001 digit is not accurate because of environmental reasons (i.e., humidity, air current, fingerprint residue, etc.). Five cc of Ultreen TM were added to half of the petri dishes and five cc of Blend 56 were added to the rest. The dishes sat at room temperature until they were dry and then weighed and observed.

Results

The test results are reported below in Table 2. Based on these results, it can be concluded that neither Ultreen TM nor Blend 56 leave a residue.

TABLE 2

| | Weight in Grams | | | | |
|---|---|---|---|---|---|
| Test | 1 | 2 | 3 | 4 | 5 |
| Ultreen TM | | | | | |
| Before | 12.46 | 12.5798 | 16.4026 | 12.4643 | 65.2727 |
| After | 12.46 | 12.5809 | 16.403 | 12.4646 | 65.2738 |
| Change | 0 | 0.0001 | 0.0004 | 0.0003 | 0.0011 |
| Blend 56 | | | | | |

TABLE 2-continued

| | Weight in Grams | | | | |
|---|---|---|---|---|---|
| Test | 1 | 2 | 3 | 4 | 5 |
| Before | 13.81 | 12.464 | 13.8071 | 12.5796 | 13.8074 |
| After | 13.81 | 12.4641 | 13.8069 | 12.5799 | 13.8072 |
| Change | 0 | 0.0001 | −0.0002 | 0.0003 | −0.0002 |

E. CLEANING EFFECTIVENESS TEST

Description of Test

Starting with visibly dirty/contaminated components, clean the VCR with a 61000 cleaner device using Ultreen TM. Use close-up pictures to determine the before and after effects of cleaning. Repeat cleaning until components have no dirt/contamination on them. Duplicate the above test using an Allsop High End Audio Cleaner on an Audio Tape Deck, an Allsop 51000 Cleaner on a CD Player, and an Allsop 54000 Cleaner on a ¼" Computer Tape Drive. Re-contaminate heads and clean with Blend 56.

Materials and Methods

An audio tape deck head, a VCR pick-up, and a ¼" computer tape drive head were contaminated with WD40 and magnetic media from scrapings from a tape and a floppy disc. The oil and dirt were baked on at 120° F. for four hours. Photos were taken of each item before and after each cleaning with a 35 mm camera that was mounted on a Unitron microscope using 400 ASA film.

Results

Each item was 90% to 95% clean after the first cleaning and 100% clean after the second cleaning. The only dirt remaining after the first cleaning was on the outer edges of the heads, in hard-to-reach recesses. The results were the same for both Ultreen TM and Blend 56.

Conclusion

In examining Ultreen TM, it was found that Ultreen TM evaporates more than seven times slower than Blend 56; that it does not harm products even after contacting them for a long period of time, with the exception of label adhesive; that it does not leave a residue; and that it cleans excessively dirty equipment 90% to 95% on the first cleaning. It does not seem to have an effect on equipment after an excessive amount of cleaning cycles (referring to the Life Test).

While the present invention has been described in conjunction with the preferred embodiments and specific examples, the description is intended to illustrate the invention and is not meant to limit it, unless such limitation is necessary to avoid the pertinent prior art. One of ordinary skill in the art after reading the foregoing specification will be able to effect various changes, substitutions of equivalents, and other alterations to the methods and compositions set forth herein. Therefore, the protection granted by Letters Patent should be limited only to the definitions contained in the appended claims and equivalents thereof.

The embodiments of the invention in which an exclusive property or privilege is claimed are defined as follows:

1. A liquid solution, consisting essentially of:

(a) at least one isoparaffinic hydrocarbon solvent having a boiling point of from about 300° to 405° F. and a flash point above about 100° F.; and (b) at least one glycol ether;

wherein said glycol ether has the following formula:

$$R-O-((\underset{\underset{R''}{|}}{C}-H)_X-O)_Y-R'$$

wherein X is 2 or 3; Y is 1, 2, or 3; and R, R', and R'' are independently selected from H and $C_{1-6}$ alkyl, with the proviso that at least one of R and R' is not hydrogen.

2. A liquid solution according to claim 1, wherein said isoparaffinic hydrocarbon solvent is a mixture of $C_8$–$C_{12}$ branched aliphatic hydrocarbons having boiling points of from about 300° to 405° F.

3. A liquid solution according to claim 2, wherein said boiling points are from 315° to 375° F.

4. A liquid solution according to claim 1, wherein said isoparaffinic hydrocarbon solvent comprises an isoparaffinic hydrocarbon solvent having a boiling point range of from about 315° to 348° F. and a flash point above about 100° F.

5. A liquid solution according to claim 1, wherein said isoparaffinic hydrocarbon solvent comprises an isoparaffinic hydrocarbon solvent having a boiling point range of from about 348° to 375° F. and a flash point of about 127° F.

6. A liquid solution according to claim 1, wherein said isoparaffinic hydrocarbon solvent comprises a mixture of an isoparaffinic hydrocarbon solvent having a boiling point range of from about 315° to 348° F. and a flash point above about 100° F. and an isoparaffinic hydrocarbon solvent having a boiling point range of from about 348° to 375° F. and a flash point of about 127° F.

7. A liquid solution according to claim 1, wherein said glycol ether is propylene glycol n-butyl ether or dipropylene glycol n-butyl ether.

8. A liquid solution according to claim 1, wherein said isoparaffinic solvent is contained in an amount of from about 95 to 98% by volume, and said glycol ether is contained in an amount of from about 2 to 5% by volume.

9. A liquid solution according to claim 1, further comprising: a branched monohydric alcohol from 4 to 8 carbon atoms.

10. A liquid solution according to claim 9, wherein said alcohol is 2-methyl-1-pentanol.

11. A liquid solution according to claim 9, wherein said alcohol is 2-ethyl-1-butyl alcohol.

12. A liquid solution according to claim 9, wherein said alcohol is contained in an amount of about 5 to 35% by volume.

13. A liquid solution consisting essentially of:

about 5 to 35% by volume of a branched monohydric alcohol having from 4 to 8 carbon atoms; about 60 to 93% by volume of one or a mixture of isoparaffinic hydrocarbon solvents having a boiling point of from 300° to 405° F., and about 2 to 5% by volume of a glycol ether;

wherein said glycol ether has the following formula:

$$R-O-((\underset{\underset{R''}{|}}{C}-H)_X-O)_Y-R'$$

wherin X is 2 or 3; Y is 1, 2, or 3; and R, R', and R'' are independently selected from H and $C_{1-6}$ alkyl, with the proviso that at least one of R and R' is not hydrogen.

14. A liquid solution, comprising:

(a) at least one isoparaffinic hydrocarbon solvent having a boiling point of from about 300° to 405° F. and a flash point above about 100° F. in an amount from about 95 to 98% by volume; and (b) at least one glycol ether in an amount from about 2 to 5% by volume;

wherein said glycol ether has the following formula:

$$R-O-((\underset{\underset{R''}{|}}{C}-H)_X-O)_Y-R'$$

wherein X is 2 or 3; Y is 1, 2, or 3; and R, R', and R'' are independently selected from H and $C_{1-6}$ alkyl, with the proviso that at least one of R and R' is not hydrogen.

15. A liquid solution, comprising:

(a) at least one isoparaffinic hydrocarbon solvent having a boiling point of from about 300° to 405° F. and a flash point above about 100° F.;

(b) at least one glycol ether; and (c) a branched monohydric alcohol having from 4 to 8 carbon atoms;

wherein said glycol ether has the following formula:

$$R-O-((\underset{\underset{R''}{|}}{C}-H)_X-O)_Y-R'$$

wherein X is 2 or 3; Y is 1, 2, or 3; and R, R', and R'' are independently selected from H and $C_{1-6}$ alkyl, with the proviso that at least one of R and R' is not hydrogen.

16. A liquid solution according to claim 15, wherein said alcohol is 2-methyl-1-pentanol.

17. A liquid solution according to claim 15, wherein said alcohol is 2-ethyl-1-butyl alcohol.

18. A liquid solution according to claim 15, wherein said alcohol is contained in an amount of about 5 to 35% by volume.

19. A liquid solution, consisting essentially of:

(a) a first isoparaffinic solvent having a boiling point range of from about 315° to 348° F. and a flash point above about 100° F.;

(b) a second isoparaffinic solvent having a boiling point range of from about 348° to 375° F. and a flash point of about 127° F.; and (c) a glycol ether;

wherein said glycol ether has the following formula:

$$R-O-((\underset{\underset{R''}{|}}{C}-H)_X-O)_Y-R'$$

wherein X is 2 or 3; Y is 1, 2, or 3; and R, R', and R'' are independently selected from H and $C_{1-6}$ alkyl, with the proviso that at least one of R and R' is not hydrogen.

20. A liquid solution according to claim 19, wherein:

said first isoparaffinic solvent is present in an amount of about 83% by volume;

said second isoparaffinic solvent is present in an amount of about 14% by volume; and said glycol ether comprises propylene glycol n-butyl ether present in an amount of about 3% by volume.

* * * * *

UNITED STATES PATENT AND TRADEMARK OFFICE

CERTIFICATE OF CORRECTION

PATENT NO. : 5,145,523

DATED : September 8, 1992

INVENTOR(S) : J.M. Halpin et al.

It is certified that error appears in the above-identified patent and that said Letters Patent is hereby corrected as shown below:

| COLUMN | LINE | |
|---|---|---|
| 9 (Claim 9, Line 2) | 45 | after "alcohol" insert --having-- |
| 10 (Claim 13, Line 12) | 1 | "wherin" should read --wherein-- |

Signed and Sealed this

Thirty-first Day of August, 1993

Bruce Lehman

*Attest:*

BRUCE LEHMAN

*Attesting Officer*

*Commissioner of Patents and Trademarks*